US005900693A

United States Patent [19]

Azzi et al.

[11] Patent Number: 5,900,693

[45] Date of Patent: May 4, 1999

[54] DEFLECTION YOKE WITH SADDLE-SHAPED VERTICAL DEFLECTION COILS

[75] Inventors: Nacerdine Azzi, Genlis; Olivier Masson, Cuisery, both of France

[73] Assignee: Thomson Tubes & Displays S.A., Boulogne, France

[21] Appl. No.: 08/750,307

[22] PCT Filed: Jun. 19, 1995

[86] PCT No.: PCT/IB95/00496

§ 371 Date: Dec. 5, 1996

§ 102(e) Date: Dec. 5, 1996

[87] PCT Pub. No.: WO95/35578

PCT Pub. Date: Dec. 28, 1995

[30] Foreign Application Priority Data

Jun. 22, 1994 [EP] European Pat. Off. ..... 94401391

[51] Int. Cl.[6] ..... H01J 29/70

[52] U.S. Cl. ..... 313/440; 335/310

[58] Field of Search ..... 313/440; 335/310, 335/313

[56] References Cited

U.S. PATENT DOCUMENTS

| | | | |
|---|---|---|---|
| 4,041,428 | 8/1977 | Kikuchi et al. | 335/210 |
| 4,110,793 | 8/1978 | Tajiri | 358/248 |
| 4,122,422 | 10/1978 | Hasegawa et al. | 335/213 |
| 4,143,345 | 3/1979 | Barkow | 335/212 |
| 4,200,851 | 4/1980 | Nieuwendijk et al. | 335/210 |
| 4,329,671 | 5/1982 | Gross et al. | 335/213 |
| 4,376,924 | 3/1983 | Gross et al. | 335/210 |
| 4,639,703 | 1/1987 | Metcalfe | 335/213 |
| 4,789,806 | 12/1988 | Meershoek | 313/440 |
| 5,001,390 | 3/1991 | Vink et al. | 313/440 |
| 5,121,028 | 6/1992 | Milili | 313/440 |
| 5,166,576 | 11/1992 | Roussel et al. | 313/440 |
| 5,465,026 | 11/1995 | Roussel et al. | 313/440 |
| 5,506,469 | 4/1996 | Vink et al. | 313/440 |

FOREIGN PATENT DOCUMENTS

| | | |
|---|---|---|
| 2401514 | 3/1979 | France . |
| 91/18410 | 11/1991 | WIPO . |

OTHER PUBLICATIONS

Proceedings of the SID, vol. 28, No. 1, 1987 Los Angeles US, A. Seyno Sluyterman "Fifth–order trilemma in deflection yoke design", pp. 9–13.

*Primary Examiner*—Vip Patel

*Attorney, Agent, or Firm*—Joseph S. Tripoli; Joseph J. Laks; Sammy S. Henig

[57] ABSTRACT

A deflection yoke for a cathode ray tube having a large, flat faceplate and a 4:3 aspect ratio includes a saddle-shaped vertical deflection coil. Most of the winding turns at a rear end portion are concentrated close to the beam entrance end of the coil. Both the position of the peak and the vertical deflection center of the vertical deflection field are shifted toward the gun entrance end with respect to the corresponding peak and deflection center of the horizontal deflection field. Consequently, North-South magnets are not required for reducing North-South pincushion distortion. Also, a much shortened yoke is obtained than if the peak were not shifted.

15 Claims, 6 Drawing Sheets

DEFLECTION YOKE WITH SADDLE-SHAPED VERTICAL DEFLECTION COILS

The invention relates to a color picture tube (CRT) display system.

A CRT with a large screen size such as 89 cm diagonal that is substantially flat is more susceptible to geometry distortions than a CRT with a faceplate that is not flat. To attain a high performance, a saddle-saddle (S-S) deflection yoke has been utilized. An S-S deflection yoke has the advantage of providing design flexibility not available in a saddle-toroid (S-T) construction.

North-South pin (NS-pin) distortion is a geometrical distortion that distorts straight horizontal lines into parabolas. NS-pin distortion is more difficult to correct in a CRT having a 4:3 aspect ratio than in a CRT having a 16:9 aspect ratio. Permanent magnets have been used for correcting NS-pin distortion in a CRT having a 4:3 aspect ratio. This is accomplished by mounting two small bar magnets horizontally at top and bottom, respectively, of the front end of the vertical deflection coil, referred to as pin-magnets. It may be desirable to reduce the NS-pin distortion in a CRT having a 4:3 aspect ratio without using permanent magnets. This is so because the tolerance in permanent magnets tend to vary over a wide range. Furthermore, when the screen of the CRT is large such as 89 cm diagonal, the magnets may not provide adequate correction. Additionally, magnets may have an undesirable effect on, for example, convergence or color purity.

SUMMARY OF THE INVENTION

A deflection yoke embodying an aspect of the invention includes a vertical deflection winding disposed adjacent a core for producing a vertical deflection field. The vertical deflection winding includes a pair of saddle shaped coils, each having a plurality of winding turns that form first and second side sections extending in a longitudinal direction of the yoke. The vertical deflection winding includes a front endturn section, disposed adjacent a screen end of the yoke between the first and second side sections and a rear endturn section disposed remote from the screen end and between the side sections. The rear endturn section are constructed in a manner to concentrate the majority of its winding turns close to the gun end. A ratio less than 0.15 is maintained between a length of a region of the rear endturn section that includes 50% of all the winding turns in the rear endturn section, including the winding turn closest to the gun end, and the effective length of the vertical magnetic field. The result is that a vertical deflection center is shifted toward a gun side of said yoke relative to a horizontal deflection center. A ratio between a first length separating the deflection centers and an effective length of the vertical deflection field is greater than 0.09 so as to significantly reduce raster distortion.

DETAILED DESCRIPTION

Figure 1:
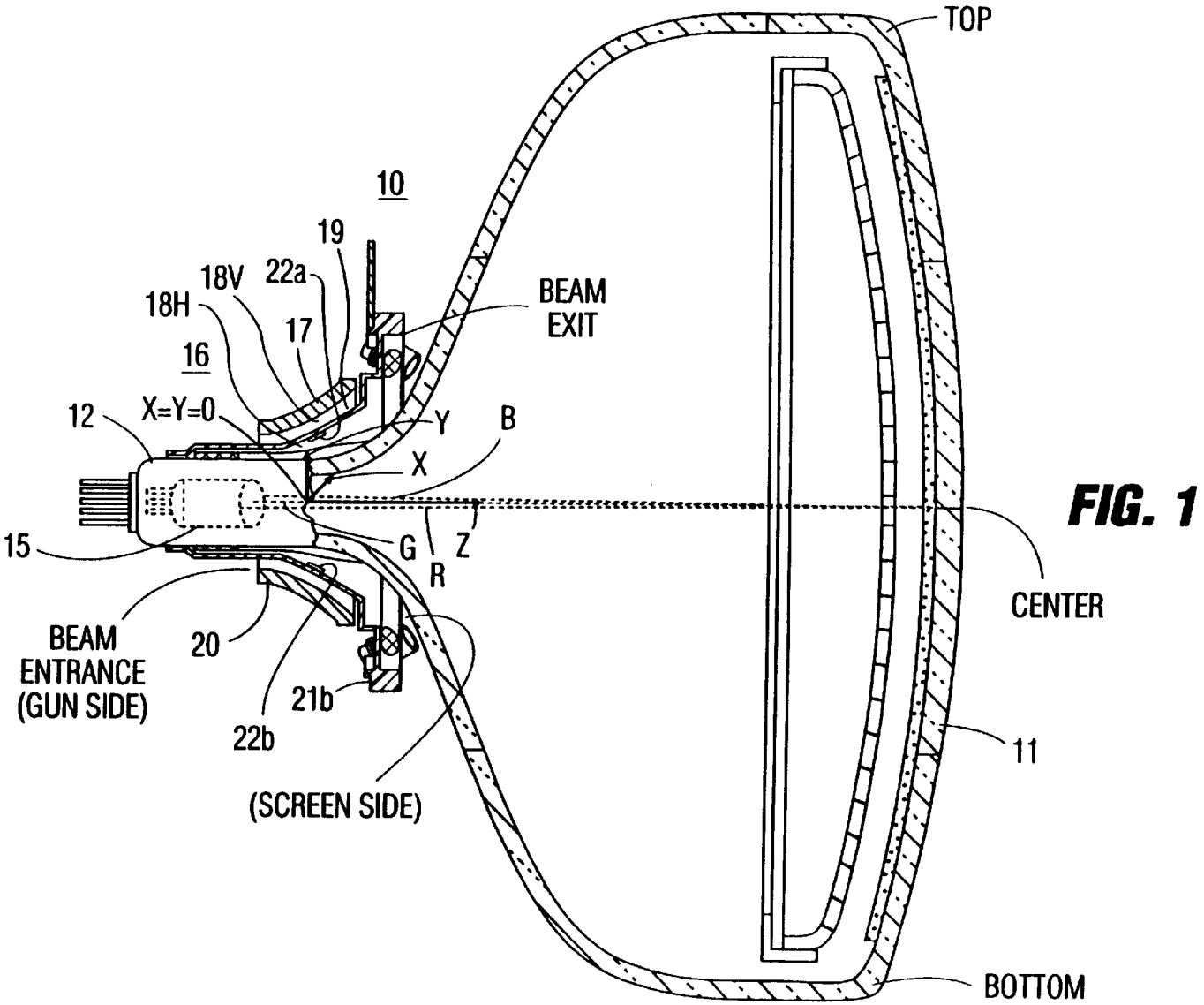
FIG. 1 illustrates a cross section of a deflection yoke, embodying an aspect of the invention, mounted on a cathode ray tube.

In FIG. 1, a CRT 10 includes a screen or faceplate 11 upon which are deposited repeating groups of red, green and blue phosphor trios. CRT 10 is of the type A89FDT with a Super-Flat faceplate size 35V or 89 centimeter along a diagonal. The maximum deflection angle is 108°. The distance from the yoke reference line to the inside of the screen at the screen center, referred to as the throw distance, is 366 millimeter. The faceplate 11 has an aspect ratio of 4:3.

The contour of the inner surface of the faceplate 11 is defined by the following equation.

$$Z_c = A1 \cdot X^2 + A^2 \cdot X^4 + A3 \cdot Y^2 + A4 \cdot X^2 \cdot Y^2 + A5 \cdot X^4 \cdot Y^2 + A6 \cdot Y^4 + A7 \cdot X^2 \cdot Y^4 + A8 \cdot X^6 \cdot Y^4 + A9 \cdot Y^6$$

where:

$Z_c$ is the distance from a plane tangent to the center of the inner surface contour.

X and Y represent distances from the center, in the directions of the major and minor axes, respectively.

A1 to A9 are coefficients that depend on the diagonal dimension of the faceplate.

For a tube faceplate of CRT 10 with a viewing screen having a diagonal dimension of 89 cm, suitable coefficients A1 to A9 are shown in Table I. A CRT with the contour defined by these coefficients may benefit in NS-pin distortion characteristics when using inventive features described later on. The X and Y dimensions must be in millimeters to use the coefficients of the Table.

TABLE

| | | |
|---|---|---|
| A1 = | 0.201580000 | $\times 10^{-03}$ |
| A2 = | 0.281067084 | $\times 10^{-09}$ |
| A3 = | 0.265056338 | $\times 10^{-03}$ |
| A4 = | −0.420000000 | $\times 10^{-09}$ |
| A5 = | −0.356545690 | $\times 10^{-14}$ |
| A6 = | 0.915000000 | $\times 10^{-09}$ |
| A7 = | −0.880800000 | $\times 10^{-14}$ |
| A8 = | 0.140253045 | $\times 10^{-24}$ |
| A9 = | 0.295636862 | $\times 10^{-14}$ |

An electron gun assembly 15 of FIG. 1 is mounted in a neck portion 12 of the tube opposite the faceplate. Gun assembly 15 produces three horizontal in-line beams R, G and B. A saddle-saddle deflection yoke assembly designated generally as 16 is mounted around the neck and flared portion of the tube by a suitable yoke mount or plastic liner 19. Yoke 16 also includes a flared ferrite core 17, a pair of saddle type vertical deflection coils 18V, embodying an inventive feature, and a pair of saddle type horizontal deflection coils 18H. Deflection yoke 16 is of the self-convergence and coma free type.

Figure 2:
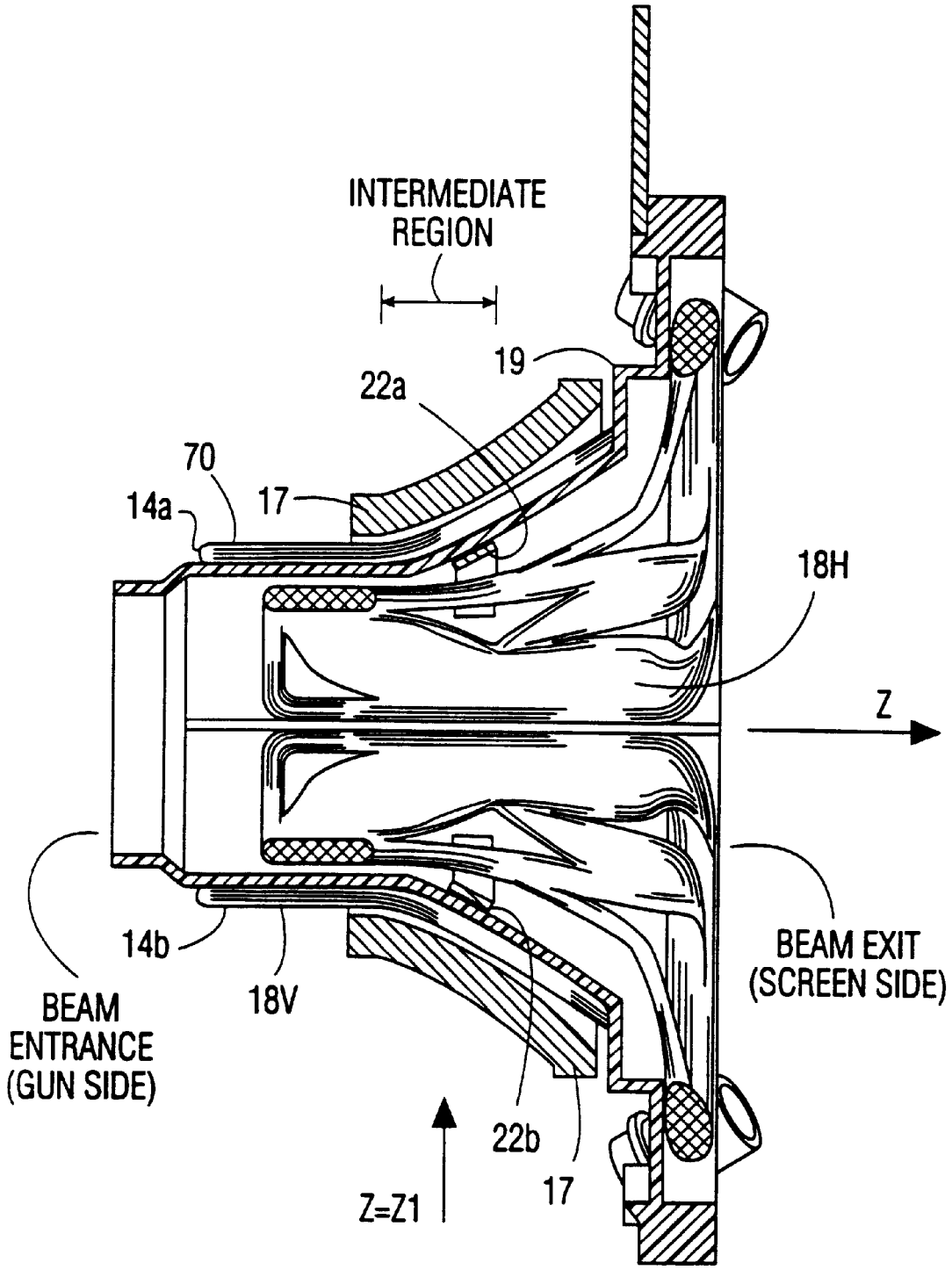
FIG. 2 illustrates a more detailed side cross section of the yoke of FIG. 1.
Figure 3:
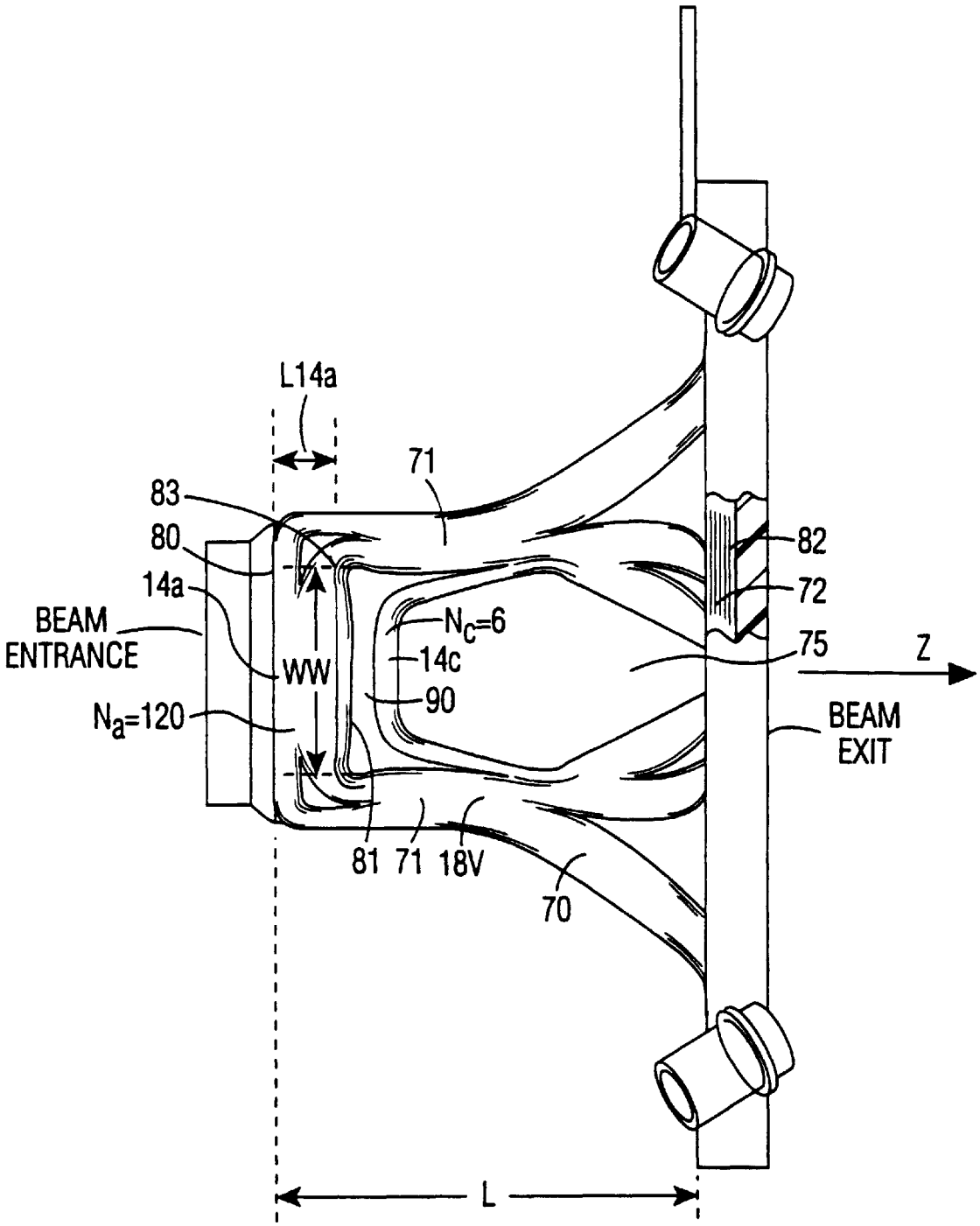
FIG. 3 illustrates a side view of a vertical deflection coil that is included in the yoke of FIG. 1.

FIG. 2 illustrates a cross section side view of yoke 16, including core 17. FIG. 3 illustrates a side view, and FIG. 4 a top view of yoke 16 when core 17 is removed for the purpose of showing coil 18V in more detail. Similar symbols and numerals in FIGS. 1–4 indicate similar items or functions.

Figure 4:
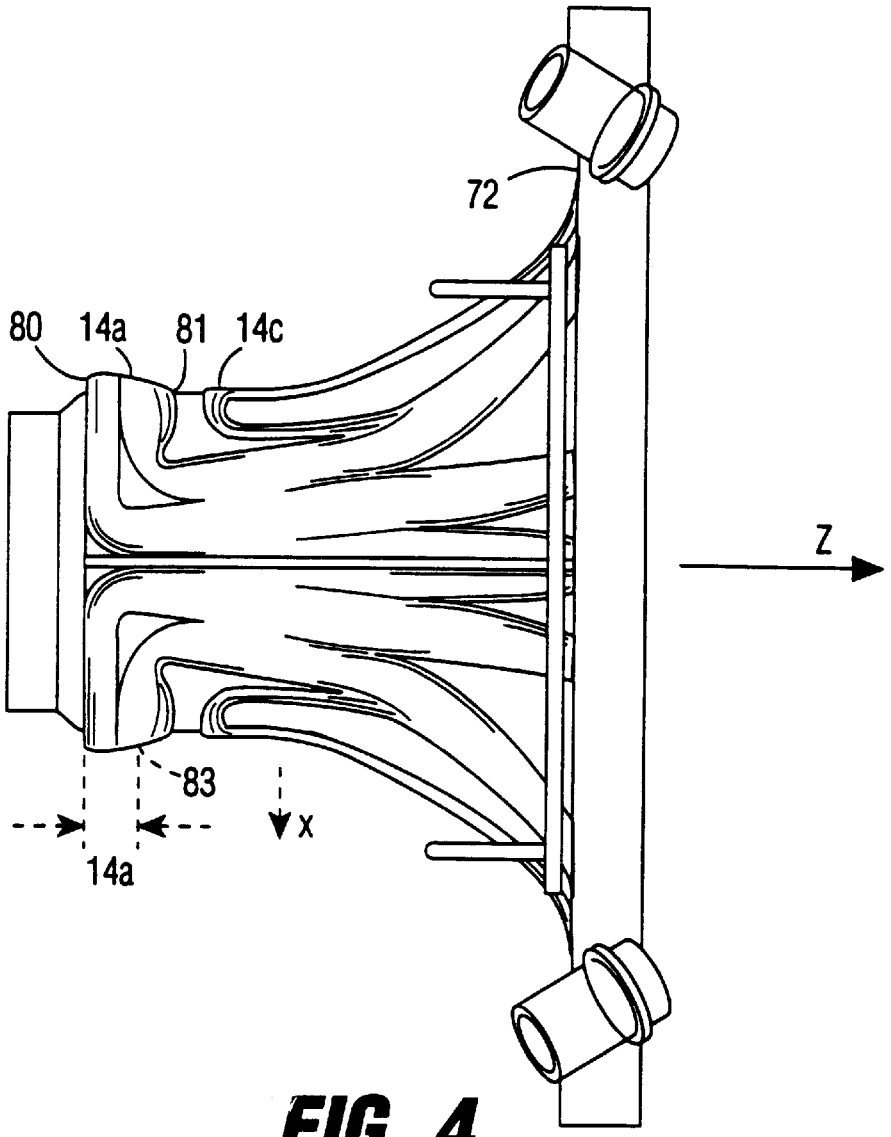
FIG. 4 illustrates a top view of the vertical deflection coil of FIG. 1.

Plastic yoke mount 19 of FIG. 2 serves to hold saddle-type horizontal deflection coils 18H and saddle-type vertical deflection coils 18V in proper orientation relative to each other and relative to flared ferrite core 17 that surrounds both coils 18V and 18H. Each saddle coil 18V of FIG. 3 is formed by winding turns 70 that include all the winding turns of the coil. Winding turns 70 having N70=126 winding turns have a rear endturn section 14*a* adjacent the beam entrance end of electron gun 15 of FIG. 1 (the gun side or end). Section 14*a* has N*a*=120 winding conductors. Saddle coil 18V of FIG. 3 has also a rear endturn section 14*c* having Nc=6 winding condutors. Saddle coil 18H have a rear endturn section 14*b*. Sections 14*a* and 14*b* and 14*c* of FIGS. 2–4 are not bent away from the neck of the tube, and are referred to herein as flat rear endturns. With a saddle coil of that type, core 17 may be formed as a single piece.

A longitudinal or Z-axis of yoke 16 or CRT 10 of FIG. 1 is defined in a conventional manner. In each plane of yoke 16 defined by a corresponding coordinate Z that is perpendicular to the Z-axis, a corresponding Y-axis is defined in parallel to a vertical or minor axis of screen 11. Similarly, a corresponding X-axis is defined in parallel to a horizontal or major axis of screen 11. The coordinate X=Y=0 in each plane of yoke 16 is located on the Z-axis.

Winding turns 70 of FIG. 3 that include all the winding turns of coil 18V form a pair of side sections 71 and a front endturn section 72 of the corresponding saddle coil 18V. Winding turns 70 also form rear endturn section 14*a* that extends from a winding turn 80 that is at one extreme closer to the gun side, up to a winding turn 81. Advantageously, there is no significant gap, where no winding turn is present, in the winding turns of section 14*a,* i.e. between winding turns 80 and 81 in section 14*a*. The majority (Na=120) of the winding turns of winding turns 70 form rear endturn section 14*a*. Whereas, a significantly smaller number (Nc=6) of winding 70 form rear endturn section 14*c*. A gap 90 in the windings separates section 14*c* from section 14*a*. Section 14*c* is disposed further from the beam entrance end of yoke 16 than section 14*a*.

In accordance with an inventive feature, those winding turns of winding turns 70 that form section 14*c* are used for reducing internal trilemma.

Front endturn section 72 and rear endturn sections 14*a* and 14*c* are disposed generally in a direction perpendicular to the Z-axis. Side sections 71 extend between the beam entrance end and the beam exit end of yoke 16. A substantial number (Na=120) of winding turns 70 of coil 18V that form section 14*a* of FIG. 2 are generally more remote from faceplate 11 and closer to gun assembly 15 of FIG. 1 than the winding turns that forms endturn section 14*b* of coils 18H of FIG. 2. The effect on the deflection field of winding window 75 of FIG. 3 that is formed by winding turns 70 is determined by a distance WW between sections 71.

Figure 5:
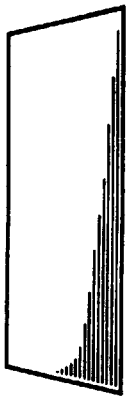
FIG. 5 illustrates a shunt that is included in the yoke of FIG. 1.

Each shunt of a pair of shunts 22*a* and 22*b* of FIGS. 1 and 2 having a trapezoidal shape as shown in FIG. 5, is disposed symmetrically with respect to axis Y. Shunt 22*b* of FIGS. 1 and 2 is disposed at 6 o'clock and the shunt 22*a* is disposed at 12 o'clock on axis Y, in a symmetrical manner with respect to axis X. The trapezoidal construction enables each of shunts 22*a* and 22*b* of FIG. 5 to occupy the same angular range at each plane X-Y in which the shunt is located.

Parameters such as angular range, length and coordinate in the Z-axis of each of shunts 22*a* and 22*b* are selected to correct external trilemma and sign reversal between external and internal trilemma. Such parameters are also selected to correct horizontal and vertical coma parabolas, which is the reversal of coma sign between the axis and corner, and to correct East-West pin. Advantageously, the simple trapezoidal or almost rectangular geometry of shunts 22*a* and 22*b* improves manufacturability and reduces sensitivity to placement of the shunt.

In the vicinity of a beam entrance end of yoke 16 of FIGS. 1–3, a vertical deflection field produced by coils 18V is preferably pincushioned-shaped for correcting vertical coma error. To reduce over-convergence at the 6 and 12 o'clock hour points, the vertical deflection field produced by vertical deflection coil 18V is made barrel-shaped at an intermediate portion of the yoke, between the beam entrance and exit ends of yoke 16. Horizontal deflection coils 18H may be of a conventional construction such as used in a conventional S-T yoke.

Figure 6:
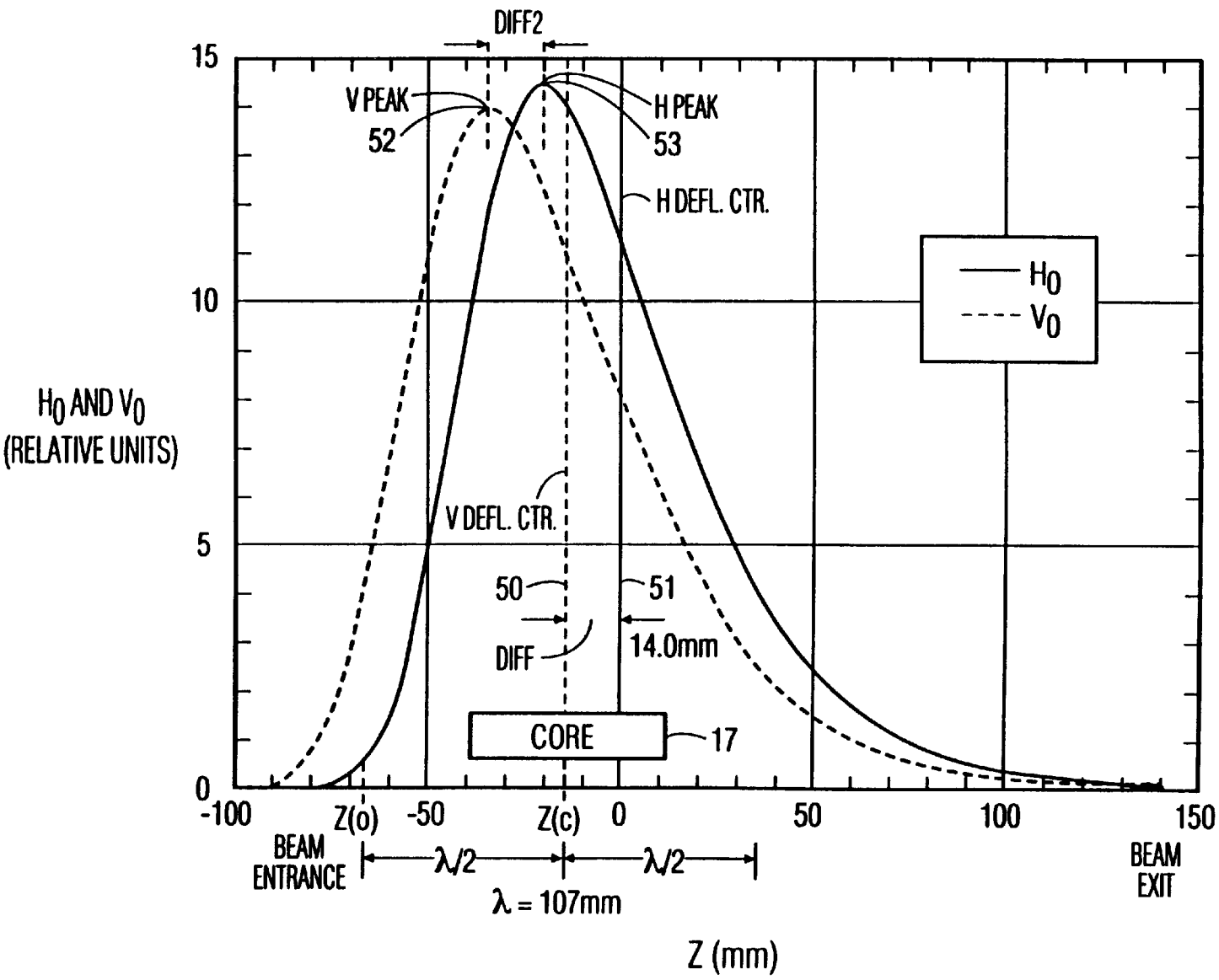
FIG. 6 illustrates field distribution functions $V_0(Z)$ and $H_0(Z)$ of the yoke of FIG. 1.
Figure 7:
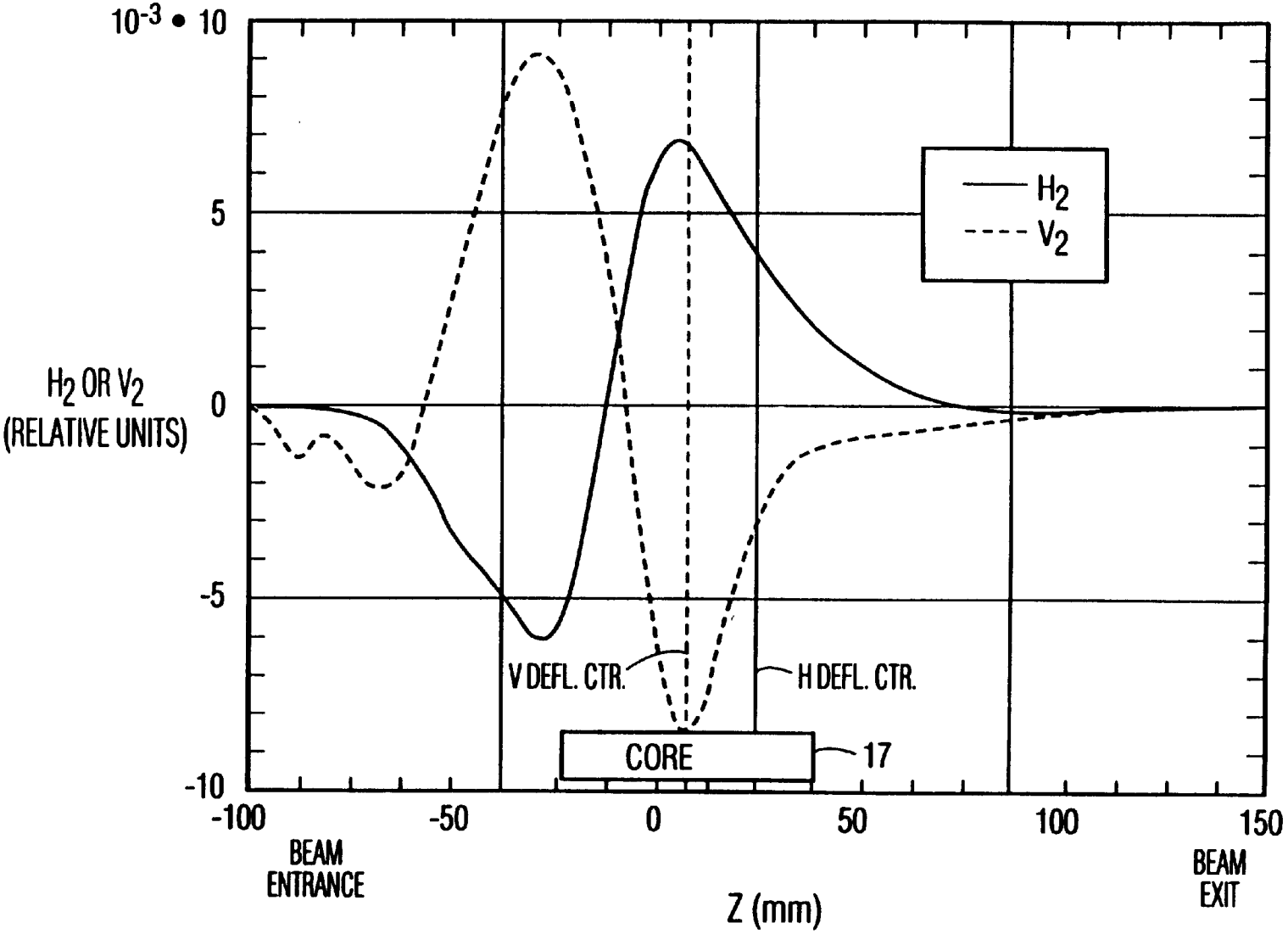
FIG. 7 illustrates field distribution functions $V_2(Z)$ and $H_2(Z)$ of the yoke of FIG. 1.

FIG. 6 illustrates in solid line a field distribution function $H_0(Z)$ that provides the magnitude of the horizontal deflection field in the direction of the X axis and in a broken line a field distribution function $V_0(Z)$ that provides the magnitude of the vertical deflection field in the direction of the Y axis in yoke 16 of FIG. 1. Functions $H_0(Z)$ and $V_0(Z)$ are used in first order abberation theory. Similarly, FIG. 7 illustrates field distribution function $H_2(Z)$ that provides the variation of the magnitude of the horizontal deflection field in the direction of the X axis and field distribtion function $V_2(Z)$ that provides the variation in the vertical deflection field in the Y direction. Functions $H_0(Z)$ and $V_0(Z)$ are used in third order abberation theory. Similar symbols in FIGS. 1–7 indicate similar items or functions. The strength or intensity of the magnetic field produced by the deflection coil 18H of FIG. 1 can be measured with a suitable probe. Such measurement can be performed for a given coordinate Z=Z1 for a coordinate Y=0 and for a given coordinate X=X1. For the purpose of measurement, coordinate X1 varies in the direction of the X-axis, the horizontal deflection direction. The plane in which coordinate X=X1 varies separates the bottom edges of top saddle coil 18H of FIG. 2 from those of bottom saddle coil 18H.

The results of measuring the strength of the magnetic field as a function of coordinate X, for a constant coordinate Z=Z1 and for coordinate Y=0, can be used for computing, in a well known manner, field distribution functions or coefficients $H_0(Z1)$, $H_2(Z1)$, $H_4(Z1)$ and other higher coefficients of a power series $H(X)=H_0(Z1)+H_2(Z1)X^2+H_4(Z1)X^4$. The term H(X) represents the strength of the magnetic field as a function of the X coordinate, at the coordinates Z=Z1, Y=0. A graph can then be plotted depicting the variation of each of the coefficients $H_0(Z)$, $H_2(Z)$, $H_4(Z)$, and other higher order coefficients, as a function of the coordinate Z. In an analogous manner, coefficients $V_0(Z)$, $V_2(Z)$, $V_4(Z)$ and other higher order coefficients can be evaluated as a function of the coordinate Z with respect to vertical deflection coil 18V. To obtain the functions shown in FIGS. 6 and 7 each of the coordinates X and Y are measured in millimeters.

A vertical deflection center 50 is defined as the coordinate Z=Z(c) of FIG. 6 of a vertical line that divides the area bounded by the curve of function $V_0(Z)$ into two parts of equal areas, one to its right side and the other one to its left side. Vertical deflection center Z(c) is equal to $$\frac{\int V_0(Z)\cdot Z\cdot dz}{\int V_0(Z)\cdot dz}$$

A horizontal deflection center coordinate 51 is defined in a similar manner.

An effective length λ of the vertical deflection field is defined as a vertical deflection field of constant magnitude extending from Z=Z(0) to Z=Z(0)+λ that causes approximately the same image field curvature as the actual $V_0(Z)$ field. The vertical deflection field is assumed centered about Z=Z(c)=Z(0)+λ/2.

Length λ is equal to $$\frac{\left(\int V_0(Z)dz\right)^2}{\int V_0(Z)^2 dz}$$

A vertical deflection peak coordinate 52 is defined as the coordinate Z in which a peak VPEAK of function $V_0(Z)$ occurs. Similarly, a horizontal deflection peak coordinate 53 is defined as the coordinate Z in which a peak HPEAK of function $H_0(Z)$ occurs.

In accordance with an inventive feature, by extending most of winding turns 70, that form endturn section 14*a* of FIG. 2, closer to gun assembly 15 of FIG. 1 than endturn section 14*b* of FIG. 2, vertical deflection center coordinate 50 of FIG. 6 is shifted significantly toward gun assembly 15 of FIG. 1 with respect to horizontal deflection center coordinate 51 of FIG. 6. In FIG. 6, a difference DIFF between the deflection centers is 14 millimeter. The effective length λ of the vertical deflection field is 107.1 mm. A ratio between difference DIFF and the effective length λ of the vertical deflection field of yoke 16 is equal to 14/107.1=0.13.

When such ratio of 0.13 is employed, the reduction in NS-pin distortion obtained is so effective that NS-pin magnets are no longer required for eliminating NS-pin distortion on flat faceplate 11 of CRT 10 of FIG. 1 having an aspect ratio of, for example, 4:3 and a size of 89 cm or 35V.

The shifting of vertical deflection center coordinate 50 closer to the gun side or beam entrance end results in such ratio between difference DIFF and the effective length λ of the vertical deflection field of yoke 16 that is greater than 0.09. Such arrangements significantly reduces NS-pin distortion when such ratio is smaller than 0.09, the reduction of NS-pin distortion may not be significant. When such ratio is greater than 0.11 NS-pin magnets are no longer required for eliminating NS-pin distortion of a faceplate CRT, not shown, having an aspect ratio that, for example, 16:9 and a size of equal to 34V.

In accordance with another inventive feature, the aforementioned significant magnitude of difference DIFF of FIG. 6 between vertical deflection center coordinate 50 and horizontal deflection center coordinate 51 is produced without significantly lengthening vertical deflection coil 18V of FIG. 1. As shown in FIG. 6, the curve of function $V_0(Z)$ has a shape that is similar to that of function $H_0(Z)$ except for being shifted towards the beam entrance end.

The shifting of vertical deflection center 50 toward gun assembly 15 of FIG. 1 is obtained by shifting vertical deflection peak coordinate 52 of FIG. 6 relative to horizontal deflection peak coordinate 53 by a length, DIFF2=13.4 mm, that is approximately equal to difference DIFF. The ratio between difference DIFF2 between coordinates 52 and 53 and the effective length λ of the vertical deflection field is equal to 0.125. By maintaining such ratio greater than at least 0.06, a total length L of coil 18V of yoke 16 of FIG. 3 in the direction of the Z-axis is maintained small. Length L is measured between a winding turn 82 that is closest to the screen end, in front endturn section 72, and winding turn 80 that is closest to the gun side in section 14*a*.

Such ratio that is greater than 0.06 is maintained by forming endturn section 14*a* from the majority (95% in this illustration) of the rear portions of winding turns 70. Advantageously, by forming section 14*c* from less than 10% (5% in this illustration) of the rear portions of winding turn 70, inner trilema can be effectively reduced.

A portion having a length $L_{14a}$=11 mm is defined as the portion of endturn section 14*a* extending from winding turn 80 of section 14*a* that is closest to the gun side of yoke 16 to a winding turn 83. Between winding turns 80 and 83, 50% of the winding turns of the winding turns of endturn sections 14*a* and 14*c*, combined, are disposed. Length $L_{14a}$ in this illustration therefore encompasses 63 winding turns. A ratio between the length $L_{14a}$ and the effective length λ of coil 18V of yoke 16 is equal to approximately 0.1. By maintaining such ratio smaller than 0.15, the total length L of coil 18V of yoke 16 is maintained small, i.e., 79.6 mm in this illustration. Coil 18V of FIG. 3 extends between the portion of winding turn 80 that is closest to the gun side and the portion of winding turn 82 that is closest to the screen side. Coil 18V is shorter than 90 mm and, therefore, has the advantage that it facilitates using CRT 10 with a short neck, hence it facilitates using a smaller size cabinet for a television receiver. Shunts 22*a* and 22*b* of FIGS. 1 and 2 enhance field distribution function $V_2(Z)$ of FIG. 7.

By concentrating the majority of the winding turns of vertical deflection coil 18V of FIG. 3 in a small region that is in general closer to the beam entrance end than the winding turns of horizontal deflection coil 18H for shifting the vertical deflection center, a short yoke can be utilized. As a result, North-South magnets can be eliminated for a large flat screen having an aspect ratio of, for example, 4:3.

What is claimed is:

1. A deflection yoke mounted on a neck of a cathode ray tube, comprising:

a core made of magnetic material;

a horizontal deflection winding disposed adjacent said core for producing a horizontal deflection field; and a vertical deflection winding disposed adjacent said core for producing a vertical deflection field including a pair of saddle shaped coils, each having a plurality of winding turns that form first and second side sections extending in a longitudinal direction of said yoke, a front endturn section, disposed adjacent a screen end of said yoke between said first and second side sections and a rear endturn section disposed remote from said screen end and between said side sections, said rear endturn section being constructed in a manner to concentrate the majority of its winding turns close to a gun end for maintaining a ratio less than 0.15 between a length of a region of said rear endturn section that includes 50% of all the winding turns in said rear endturn section, including the winding turn closest to said gun end, and a effective length of said vertical deflection field, resulting in a vertical deflection center that is shifted toward a gun side of said yoke relative to a horizontal deflection center such that a ratio between a first length separating said deflection centers and an effective length of said vertical deflection field is greater than 0.09 so as to significantly reduce raster distortion.

2. A deflection yoke according to claim 1 wherein the shifting of said vertical deflection field reduces North-South distortion such that North-South magnets are not employed.

3. A deflection yoke according to claim 1 further comprising a pair of shunts at opposite ends of an axis Y of said yoke having each a trapezoidal shape for enhancing a field distribution function $V_2(Z)$.

4. A deflection yoke according to claim 1 wherein said rear endturn section includes a first portion close to said gun end and a second portion further from said gun end and having a gap therebetween such that the majority of said winding turns are included in said first portion.

5. A deflection yoke according to claim 4 wherein said winding turns of said second portion are used for reducing internal trilema.

6. A deflection yoke for mounting on a neck of a cathode ray tube, comprising:

a core made of magnetic material;

a horizontal deflection winding disposed adjacent said core for producing a horizontal deflection field; and a vertical deflection winding disposed adjacent said core for producing a vertical deflection field having a vertical deflection center that is displaced toward a gun side of said yoke relative to a horizontal deflection center, such that a ratio is greater than 0.06 between the distance separating the point on a longitudinal axis where a peak magnitude of a field distribution function $V_0(Z)$ occurs and the point where a peak magnitude of a field distribution function $H_0(Z)$ occurs, and an effective length of said vertical deflection field.

7. A deflection yoke according to claim 6 wherein the displacement of said vertical deflection field reduces North-South distortion and North-South magnets are not employed.

8. A deflection yoke for mounting on a neck of a cathode ray tube, comprising:

a core made of magnetic material;

a horizontal deflection winding disposed adjacent said core for producing a horizontal deflection field; and a vertical deflection winding disposed adjacent said core for producing a vertical deflection field having a vertical deflection center that is shifted toward a gun side of said yoke relative to a horizontal deflection center, such that a ratio between a length separating said deflection centers and an effective length of said vertical deflection field is greater than 0.09 so as to significantly reduce raster distortion, said vertical deflection winding including a pair of saddle shaped coils each having a plurality of winding turns that form first and second side sections extending in a longitudinal direction of said yoke, a front endturn section extending between said first and second side sections close to a screen end of said yoke and a rear endturn section disposed remote from said screen end and between said side sections, such that the majority of said winding turns of said rear endturn section are disposed close to a gun end for maintaining a length of said vertical deflection winding, between winding turns at extreme ends of said front and rear endturn sections, shorter than 90 millimeters.

9. A deflection yoke according to claim 9 wherein the shifting of said vertical deflection field reduces North-South distortion such that North-South magnets are eliminated.

10. A deflection yoke for mounting on a neck of a cathode ray tube, comprising:

a core made of magnetic material;

a horizontal deflection winding disposed adjacent said core for producing a horizontal deflection field; and a vertical deflection winding disposed adjacent said core for producing a vertical deflection field having a vertical deflection center that is shifted toward a gun side of said yoke relative to a horizontal deflection center, such that a ratio between a length separating said deflection centers and an effective length of said vertical deflection field is greater than 0.09 so as to significantly reduce raster distortion, said vertical deflection winding comprising a pair of saddle shaped coils each including a plurality of winding turns that form first and second side sections extending in a longitudinal direction of said yoke, a front endturn section, disposed adjacent to a screen end of said yoke, between said first and second side sections, and a rear endturn section, disposed remote from said screen end in a direction transverse to said longitudinal direction and between said side sections, said rear endturn section including a winding portion that extends from a winding turn closest to a gun side and that includes a majority of said winding turns of said rear endturn section, said winding portion being formed without any gap between adjacent turns.

11. A deflection yoke according to claim 10 wherein the shifting of said vertical deflection field reduces North-South distortion such that North-South magnets are not employed.

12. A deflection yoke mounted on a neck of a cathode ray tube, comprising:

a core made of magnetic material;

a horizontal deflection winding disposed adjacent said core for producing a horizontal deflection field; and a vertical deflection winding disposed adjacent said core for producing a vertical deflection field including a pair of saddle shaped coils, each having a plurality of winding turns that form first and second side sections extending in a longitudinal direction of said yoke, a front endturn section, disposed adjacent a screen end of said yoke between said first and second side sections and a rear endturn section disposed remote from said screen end and between said side sections, said rear endturn section being constructed in a manner to concentrate its winding turns close to a gun end for shifting a vertical deflection center toward a gun side of said yoke relative to a horizontal deflection center such that a ratio between a first length separating said deflection centers and an effective length of said vertical deflection field is greater than 0.11 so as to significantly reduce raster distortion.

13. A deflection yoke according to claim 12 wherein the shifting of said vertical deflection field reduces North-South distortion such that North-South magnets are not employed.

14. A deflection yoke mounted on a neck of a cathode ray tube, comprising:

a core made of magnetic material;

a horizontal deflection winding disposed adjacent said core for producing a horizontal deflection field; and a vertical deflection winding disposed adjacent said core for producing a vertical deflection field including a pair of saddle shaped coils, each having a plurality of winding turns that form first and second side sections extending in a longitudinal direction of said yoke, a front endturn section, disposed adjacent a screen end of said yoke between said first and second side sections and a rear endturn section disposed remote from said screen end and between said side sections, said rear endturn section being constructed in a manner to concentrate more than 90% of its winding turns close to a gun end in a first portion of said rear endturn section and less than 10% of its winding turns closer to said screen end in a second portion of said rear endturn section such that a gap along a Z-axis is formed between said first and second portions.

15. A deflection yoke according to claim 14 wherein said second portion provides inner trilemma correction.

* * * * *